US005348046A

United States Patent [19]

Kozumplik, Jr. et al.

[11] Patent Number: 5,348,046

[45] Date of Patent: Sep. 20, 1994

[54] SPRING CHECK VALVE CARTRIDGE

[75] Inventors: Nicholas Kozumplik, Jr.; Gerald M. Distel, both of Bryan, Ohio

[73] Assignee: The Aro Corporation, Bryan, Ohio

[21] Appl. No.: 60,916

[22] Filed: May 13, 1993

[51] Int. Cl.[5] ..... F16K 15/02; F16K 15/12

[52] U.S. Cl. ..... 137/454.4; 137/543.19; 251/337

[58] Field of Search ..... 137/454.4, 543.19; 251/337

[56] References Cited

U.S. PATENT DOCUMENTS 2,950,736 8/1960 Oldberg ..... 137/543.19 X
3,849,032 11/1974 Mulvey et al. ..... 137/454.4 X
4,708,168 11/1987 Peruzzi ..... 137/454.4 X
4,773,445 9/1988 Visket ..... 251/337 X
5,010,916 4/1991 Albrecht ..... 137/543.19 X

FOREIGN PATENT DOCUMENTS 173788 7/1952 Fed. Rep. of Germany .

*Primary Examiner*—Stephen M. Hepperle
*Attorney, Agent, or Firm*—Walter C. Vliet

[57] ABSTRACT

A reversible check valve cartridge wherein a sealing disk is urged to the shutoff position by means of a cage mounted umbrella spoke-like spring which is secured to the cage and is fully recessable therein so as to permit full travel of the sealing disk within the cage, thereby permitting increased flow for a given thickness of the valve cartridge.

3 Claims, 1 Drawing Sheet

SPRING CHECK VALVE CARTRIDGE

BACKGROUND OF THE INVENTION

This invention relates generally to check valves and more particularly to a spring check valve cartridge for use with diaphragm pumps and the like and more particularly where a compact reversible flat check valve requiring minimal depth is desired.

Pumps using check valves to control flow through the pump generally rely on gravity for the checks to function particularly when there is no fluid in the pump.

The type of checks used are either a ball or a flat/disk type. They allow flow in one direction and prevent flow in the opposite direction. In a typical pump there are two checks, one on the pump inlet and one at the outlet. The inlet check allows fluid to enter the pump when a vacuum is pulled in the pumping chamber. At the same time the outlet check is closed preventing fluid or gases to enter the pumping chamber during the suction cycle. When the pump expels the fluid, the inlet check closes due to gravity and frictional drag between the check and the fluid being pumped. The outlet check is forced open due to pressure acting on the check which was generated in the pumping chamber. The cycle begins again at the end of the pumping stroke. For this type of pump to self prime the pump must be oriented such that gravity will cause the checks to seat properly.

One method used to overcome this limitation in the prior art is to use a mechanical spring to physically force the check against the seat. The arrangement works well in most cases; however, the spring is subject to fatigue failure if the pump operates at high cycle rates. Full flow rate is also reduced because the spring limits the check lift. The volume occupied by the spring loaded check is larger. Free springs may cause problems during assembly and the added volume of the check reduces the pumps' volumetric efficiency and increase the net positive suction head required for the pump to begin to operate.

The check valve feels only the difference between suction pressure and the pressure in the fluid chamber. When the pressure differential is sufficient to lift the check from its seat, the valve will begin to open. The rate of pressure drop when the pump piston or diaphragm creates a vacuum is a function of the volume ratio and the vapor pressure of the fluid pumped. Loading the check with a spring requires the pump to generate higher suction pressure in the pumping chamber to open the check.

Metallic springs cannot be used in environments where chemical compatibility between the spring and the process fluid will result in corrosion of the spring. In addition, the form of the spring may create instability in the ability of the check to seat by applying non-union or offset pressure in the direction of seating.

Other well-known forms of check valves, such as Duckbill or umbrella checks, utilize elastomeric materials which limit their use as to the type of fluids pumped and are subject to damage or being sucked inside out at high flow rates and/or high back pressure.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully described hereinafter.

SUMMARY OF THE INVENTION

In one aspect of the present invention this is accomplished by providing a spring check valve cartridge for a fluid pumping device comprising a housing having a bore forming a chamber including an inlet and an outlet to the chamber; a valve means disposed within the bore between the inlet and the outlet for limiting flow of fluid therebetween; spring biasing means operable within the bore for biasing the valve means towards a flow limiting position; and the spring biasing means being formed and positioned so as to exert a balanced force on the valve means while permitting unlimited travel of the valve means within the bore.

It is a further object of the present invention to provide a reversible compact spring loaded check valve having a wide range of use and application in pumps particularly where a low volume and minimal depth check valve is required.

It is yet a further object of the present invention to provide a check valve which is suitable for manufacture from a range of plastic materials suitable for a wide range of pumped fluids.

The foregoing and other aspects will become apparent from the following detailed description of the invention when considered in conjunction with the accompanying drawing figures.

DETAILED DESCRIPTION

Figure 1:
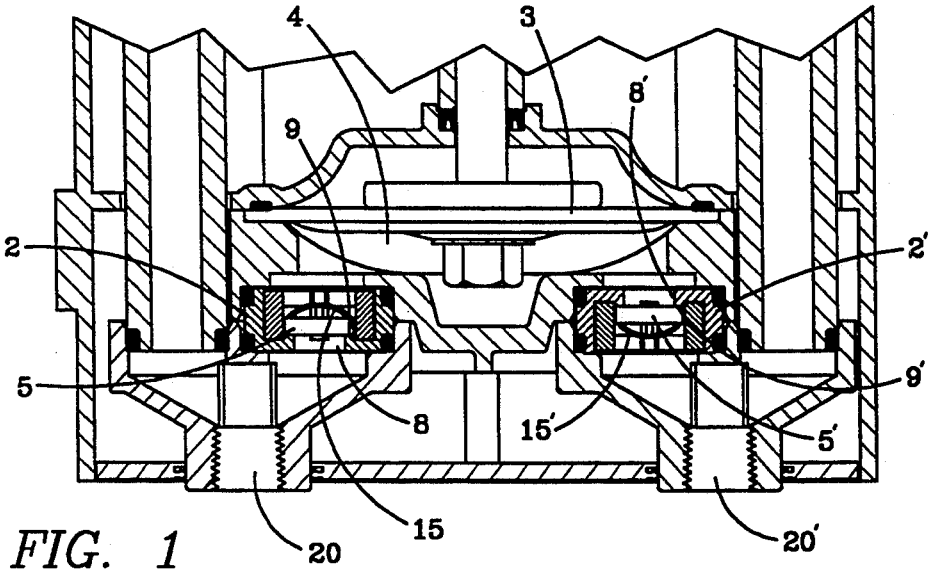
FIG. 1 is a cross section view of a diaphragm pump utilizing the spring check valve cartridges according to the present invention.

Referring to FIG. 1, a diaphragm pump housing is shown incorporating two spring check valve cartridges. An inlet check 2 is shown on the left side of the figure and an outlet check 2' is shown on the right side. As the diaphragm 3 is translated upward in the pumping chamber 4, a vacuum is created. This causes the sealing disk 5', which is held in close proximity to the outlet orifice 8' by means of an umbrella spoke-like spring 15', to be drawn tightly against the outlet valve seat, thereby sealing the pump outlet 20' against return flow of a pumped fluid. This also permits a vacuum to be drawn in chamber 4. Since the pressure inside the fluid chamber 4 is less in atmospheric, the pressure acting on disk 5 in the spring check valve cartridge 2 causes it to arise away from the valve seat 9 against the force of an umbrella spoke-like spring 15 thereby permitting an inlet flow of the pumped fluid through orifice 8 into the chamber 4.

At the end of the suction stroke, the diaphragm 3 reverses direction and begins to force the pressure fluid out of chamber 4. The disk 5 is forced to seat against seat 9 closing orifice 8 thereby preventing fluid from flowing out of the pump inlet. The pressure built in chamber 4, due to the diaphragm 3 movement, acts on disk 5' causing it to open allowing fluid to flow from chamber 4 through the orifice 8' past the valve seat 9' and around the disk 5' to the pump outlet. In general, this pumping action is well-known in the prior art.

Figure 2:
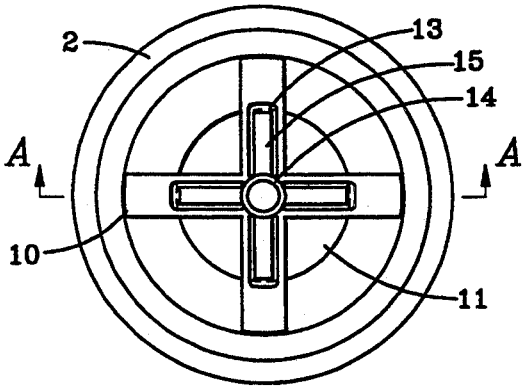
FIG. 2 is an in-line end view of a check valve cartridge viewed from the spring end according to the present invention.
Figure 3:
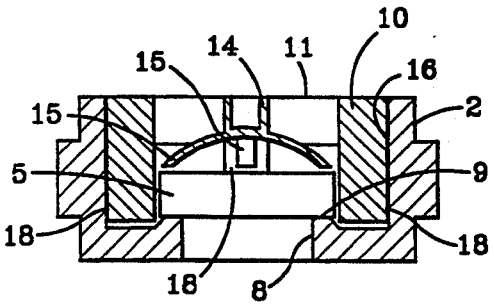
FIG. 3 is a cross sectional view of the cartridge taken at Section A—A of FIG. 2 with the valve element shown in the closed position.
Figure 4:
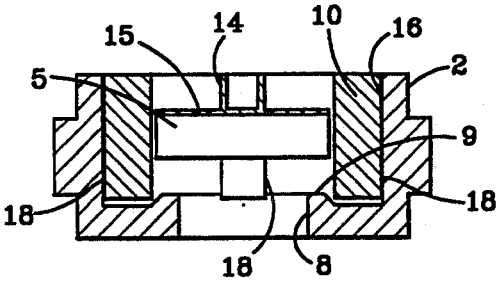
FIG. 4 is a cross sectional view of the cartridge taken at Section A—A of FIG. 2 with the valve element shown in the open position.

The compact balanced and reversible structure of the spring check valve cartridge is the subject of the present invention and is best understood by referring to FIGS. 2, 3, and 4. Both the inlet check and the outlet check are of similar construction. The check assembly is comprised of a cartridge or container housing 2 having a bore 16 forming a chamber. The chamber is bounded on one end by a partial closure forming an orifice 8 having an integral valve seat for lift 9 formed at the orifice edge. A valve check member in the form of a disk 5 is disposed for reciprocation within the bore and is retained and centralized within the bore by means of a cage element 10, which for purposes of the embodiment herein described, is provided with four extended leg elements 18 interconnected by a cross bridge 11.

The legs became the cross bridge within the bore 16 and space the bridge apart from the orifice 8, and the seat 9, with a sufficient gap to permit the disk 5 to move a sufficient distance from a closed position, as shown in FIG. 3, to an open position as shown in FIG. 4. The contract area between the seat 9 and the disk 5 forms the seat area. When the disk and seat are in contact, flow through the orifice 8 is blocked from the disk 5 side. Conversely, flow through the orifice 8 causes the disk 5 to lift off the seat 9 as shown in FIG. 4.

The cage 10 is provided with a recess 13 in the cross 11 portion of the cage. Centralized within the cross is a cylindrical finger post 14, which is attached to the cross at four intersecting points. Attached to the finger post 14, and extending into the cross recess 13, are four umbrella spoke-like fingers 15, which in their uncompressed form, extend into the cavity formed between the cross 11 and the disk 5, as best seen in FIG. 3. The fingers resiliently urge the disk 5 towards the valve seat 9 with balanced pressure at four points essentially 90 degrees apart near the outer circumference of the disk.

The four cantilevered fingers, which in this example are an integral part of the cage, are positioned to hold the disk 5 in close proximity of the seat 9. This results in a very low flow area that is high restriction, so that when fluid or gas flows through the assembly, the drag against the disk 5 will force the disk against the seat causing it to close off the orifice 8 when flow is attempted to be established in the downward direction, as shown in shown in FIG. 3.

Since the fingers 15 hold the disk in close proximity to the seat the check valve does not rely on gravity to function properly. In addition, as seen in FIG. 4, the fingers function as springs when the disk 5 is forced against them. As the flow rate increases in the upward direction, as seen in FIG. 4, this deflects the fingers 15 until the disk 5 contacts the cross 11. This results in the full flow area being open. The fingers 15 in this case are used to position the disk to function in any orientation but do not interfere with the overall movement and displacement of the disk.

As seen in FIG. 4, a feature of the present invention is the fact that in the full open position the disk is stopped by the cross 11 with the fingers 15 flattened and compressed into the cross recess 13 thereby permitting maximum opening of the valve without interference by a spring device. The structure also results in a minimal volume within the check valve thereby improving its performance in response. The open cage construction also permits a maximum amount of flow about the disk thereby permitting minimum pressure drop across the check valve for a given size valve.

The present invention allows the pump to be oriented in any position without effecting its ability to function properly. The spring fingers are designed to generate minimal force to allow the check to fully open thereby allowing a maximum flow rate. The springs additionally are an integral part of the stop which may be molded in a material which matches the wet end components of the rest of the pump thereby eliminating any chemical incompatibility problems. The construction further permits a variety of materials to be used depending on the application.

The design occupies minimal volume allowing it to be positioned in close proximity to the pumping chamber to improve pump performance and reduce overall pump size. The compact size and positioning with regard to the pump chamber reduces the amount of material required to flush the pump for cleaning and the design provides adequate suction lift in any presentation without unduly increasing net positive suction head requirements.

What is claimed is:

1. A spring check valve cartridge for a fluid pumping device comprising:

a reversible cylindrical housing having a bore forming a chamber including an inlet orifice and an outlet to said chamber;

a valve means disposed within said bore between said inlet orifice and said outlet for permitting flow of fluid in one direction therebetween;

spring biasing means operable within said bore for biasing said valve means towards a flow stopping position;

said spring biasing means being formed and positioned so as to exert a balanced force on said valve means while permitting travel of said valve means within said bore;

a cage means for retaining said spring biasing means within said bore and for receiving said spring biasing means within a cavity formed therefor in said cage means; and said spring biasing means further comprises a plurality of umbrella like fingers retained within said bore by said cage means.

2. A spring check valve cartridge for a fluid pumping device according to claim 1, wherein said valve means comprises a disk.

3. A spring check valve cartridge for a fluid pumping device according to claim 1, wherein said cage means is provided with a recess for receiving said fingers therein.

* * * * *